US005172732A

United States Patent [19]

Krumm et al.

[11] Patent Number: 5,172,732

[45] Date of Patent: Dec. 22, 1992

[54] METHOD FOR STARTING A POWER LOOM AS A FUNCTION OF STANDSTILL TIME

[75] Inventors: Valentin Krumm, Hergensweiler; Klaus Zeleny, Bodolz, both of Fed. Rep. of Germany

[73] Assignee: Lindauer Dornier Gesellschaft mbH, Lindau, Fed. Rep. of Germany

[21] Appl. No.: 774,579

[22] Filed: Oct. 10, 1991

Related U.S. Application Data

[63] Continuation-in-part of Ser. No. 546,558, Jun. 29, 1990, abandoned.

[30] Foreign Application Priority Data

Jun. 29, 1989 [DE] Fed. Rep. of Germany ..... 3921318

[51] Int. Cl.[5] ..... D03D 51/00

[52] U.S. Cl. ..... 139/1 E; 318/161; 364/921.1

[58] Field of Search ..... 364/138, 470, 148, 921.1; 139/1 E, 1 R; 318/161

[56] References Cited

U.S. PATENT DOCUMENTS 4,631,930 12/1986 Gutschmit et al. ..... 139/1 R
4,633,914 1/1987 Carry ..... 139/1 R
4,837,485 6/1989 Meroth et al. .
4,893,250 1/1990 Sainen ..... 139/1 R

FOREIGN PATENT DOCUMENTS 0371483 6/1990 European Pat. Off. ..... 139/1 E
3542650 6/1987 Fed. Rep. of Germany ..... 139/1 E

*Primary Examiner*—Andrew M. Falik
*Attorney, Agent, or Firm*—W. G. Fasse

[57] ABSTRACT

The starting or restarting of a power loom is controlled through a loom control system which controls the operation of a flywheel mass and the operation of the main electric motor of the loom. The control system ascertains the standstill time and the cause for the standstill, as well as the type of weaving binding that was employed at the time of the shut-down. These parameters are processed in a micro-processor which produces a respective result signal and uses that signal for the selection of a suitable start-up or run-up program. These programs are stored in a program library or memory. The micro-processor controls the run-up in response to the selected program, whereby conventionally occurring faults in the woven fabric are avoided. Even fabric faults caused by a standstill, are avoided.

9 Claims, 5 Drawing Sheets

METHOD FOR STARTING A POWER LOOM AS A FUNCTION OF STANDSTILL TIME

CROSS-REFERENCE TO RELATED APPLICATION

This application is a Continuation-In-Part Application of out copending application U.S. Ser. No. 07/546,558, filed on June 29, 1990 abandoned.

FIELD OF THE INVENTION

The invention relates to a method for starting a power loom having a main drive system including an electromotor. In such power looms the starting energy is primarily generated by electrically driven flywheel masses connectable to the loom drive shaft through a respective clutch when the flywheel has stored sufficient energy for bringing the loom drive shaft to a rated r.p.m.

BACKGROUND OF THE INVENTION

Prior to the actual starting of a power loom, that is prior to an electrical signal that activates the above mentioned clutch, the flywheel mass is driven by the main drive motor of the loom until an increased start-up or run-up r.p.m. relative to a rated operational r.p.m. of the loom has been reached. With or just prior to the engagement or activation of the clutch, which connects the flywheel mass to the main drive shaft of the loom, the electric drive motor is disconnected from the flywheel mass during a starting transition phase. Preferably, the same signal that engages the clutch temporarily disconnects the electric drive motor. Thereafter, the normal power supply to the electric drive motor is switched on with a certain time delay that depends on the reduction of the instantaneous r.p.m. of the flywheel masses substantially to the rated operational r.p.m. The switch-on of the drive motor takes place when the r.p.m. of the flywheel masses approaches the rated operational r.p.m. of the power loom.

U.S. Pat. No. 4,837,485 (Meroth et al.) the disclosure of which is incorporated herein by reference, describes a method and system for starting a power loom, wherein the above described operation is employed. The above mentioned time delay is adjustable. However, there is room for further improvement, especially in connection with modern high performance power looms for avoiding weaving faults, especially start-up faults.

During the operation of high performance power looms it can occur that, due to the high operational or rated r.p.m., the fabric appearance changes as a function of time, especially with regard to starting sections, creeping sections, and loom stop sections within the fabric. In practice, this fact may lead to faults in the fabric, and these faults may differ from one type of fabric to another. Such faults may occur, for example, in a loom in which the shut-down time of the electrical motor drive during flywheel start-up is adjusted to two minutes, while the actual shut-down time becomes shorter or longer. These faults are known as start-up faults.

The just described faults in the fabric are caused by the fact that new thread spinning methods result in new types of threads or yarns which have a smaller elasticity compared to older types of yarns. Such new types of yarns are, for example, open-end yarns, acetate yarns, and viscose or cellulose yarns. An open-end yarn is spun of chopped fibers providing a yarn with a desirable optical appearance, but which is very sensitive to mechanical stress. The reduced elasticity of such yarns causes creeping which, in this context, means a permanent deformation of the yarn when its elasticity limit is exceeded by the stretching of the yarn during the weaving. Such deformations cause fabric faults and the newer types of yarns cause such faults quite frequently. As a result, any down times of the loom caused by these modern yarns require evermore attention. Taking these faults into account and also considering the abilitie of individual operators, down times of up to 30 minutes are considered to be realistic in present loom operations including high performance looms. These down times should be reduced.

In the just described prior art, the flywheel of the loom is accelerated during a predetermined down time and the flywheel in turn accelerates the main loom drive shaft to an r.p.m. above the operational r.p.m. Such an operation has the disadvantage that the fixed run-up time frequently is insufficient for accelerating the main drive shaft to a required higher r.p.m. than the rated r.p.m. Incidentally, the higher r.p.m. is also referred to as the desired or selectable r.p.m. The time needed by the loom for reaching the higher selectable r.p.m. depends on a plurality of factors, for example, the temperature of the lubricant, the warp thread tension, the type of binding, the number of shafts or heald frames, the operating temperature of the entire loom, and other parameters. These parameters change with time. Therefore, it is not always possible to reach the required selectable r.p.m. during the fixed time period available for this purpose heretofore.

OBJECTS OF THE INVENTION

In view of the foregoing it is the aim of the invention to achieve the following objects singly or in combination:

to control, preferably in a closed loop, the start-up of a power loom which avoids the above outlined fabric faults by taking the mentioned factors into account when allocating the run-up time during which the selectable r.p.m. can in fact be reached under the prevailing operating conditions;

to vary the run-up times for the flywheel mass during which the main loom drive is shut down, in accordance with presently prevailing operating conditions; and to apply a start-up program to the drive and starting means of the loom, which takes the above mentioned factors into account, whereby a plurality of start-up or run-up programs are stored in a so-called program library.

SUMMARY OF THE INVENTION

According to the invention the machine control ascertains, based on the above factors or parameters, the required down time during which the main drive of the loom is switched off. These parameters also take into account the reason for the shut-down and the type of binding employed at the moment of shut-down. These parameters are supplied to a central processing unit, including a micro-processor which processes the parameters and provides a program selector signal on the basis of which the appropriate program for the start-up of the loom is selected from a memory or library. The selected program in turn controls the run-up or start-up of the loom through the loom control, whereby the run-up time is no longer fixed, but varies in accordance with the currently relevant parameters mentioned above.

Thus, the invention is based on the new and surprising recognition that the above stated parameters, including the type of shut-down and the type of binding at the time of shut-down, are necessary and sufficient for determining the proper down time for the loom and for controlling the start-up of the loom in a closed-loop manner. As a result, looms operated according to the present teaching achieve a high fabric quality independent of the particular down time required for the prevailing operating conditions.

According to the invention, the micro-processor exchanges data with a fixed memory library in which other parameters are stored which are required by the micro-processor in combination with the manually inputted parameters, in order to control the start-up of the loom in a closed loop manner in accordance with a stored program that has been selected by the micro-processor from a plurality of programs in accordance with said parameters.

BRIEF DESCRIPTION OF THE DRAWINGS

In order that the invention may be clearly understood, it will now be described, by way of example, with reference to the accompanying drawings, wherein.

DESCRIPTION OF THE PREFERRED EMBODIMENTS

Figure 1:
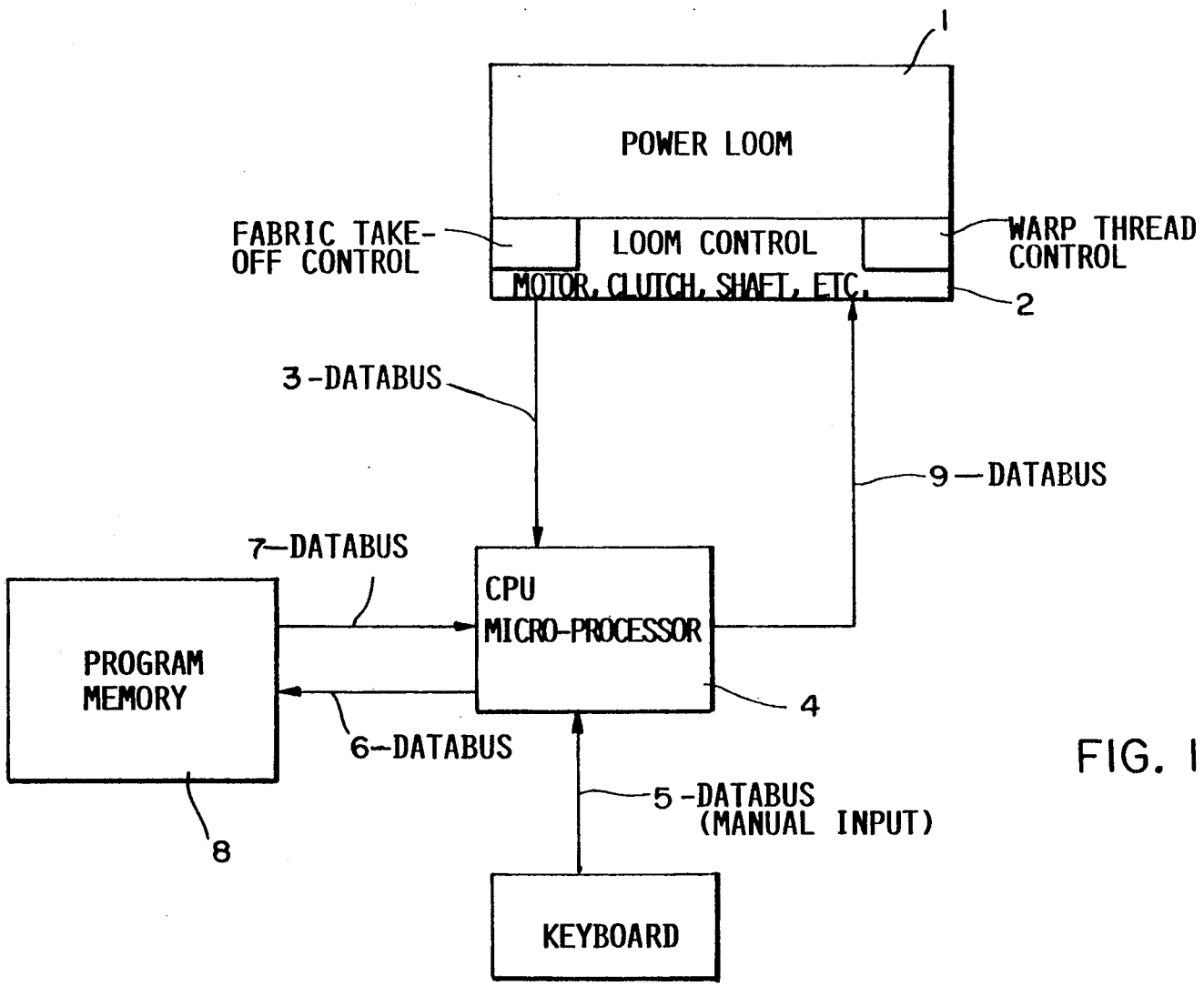
FIG. 1 shows a block diagram of the control system used for performing the present loom start-up method.

Referring to FIG. 1, any conventional power loom 1, such as a high performance loom, is connected to its control system 2 which in turn is connected by a conventional databus 3, e.g. INTEL AN82526, to a central processing unit 4 including a microprocessor of the host type and one or more CPUs. The databus 3 is a so-called CAN-bus (CAN =controller area network). The control output of the central processing unit is connected through a databus 9 to the control input of the control system 2. This control system includes all loom components that are controllable e.g. the loom drive motor and all sensors that provide signals used for controlling the loom operation. Such sensors are all conventional and include, among others, warp thread tension sensors, temperature sensors, time or pulse counters, etc. The loom 1 can, for example, be a so-called air weaving loom, a gripper rod weaving loom, a projectile weaving loom, or the like, which operates conventionally under the control of the control system 2, the latter in turn is controlled in accordance with the method of the invention which is applicable to all types of looms. The databus 9 is of the same type as bus 3.

The databus 3 supplies to the central processing unit 4 the following parameters: the duration of the standstill time of the loom as measured by a pulse counter in the control system 2, the cause of the standstill, such as a weft thread break, a warp thread break, a manual stopping of the loom, or a power failure as sensed by respective sensors in the control system 2. Additionally, information is supplied through the databus 3 which represents the type of binding that was being applied at the time when the loom stopped.

A keyboard is connected through a databus 5 to the central processing unit 4 for the manual entry of additional parameters, for example, parameters representing the type of fabric or weave being woven, loom technical parameters, yarn parameters, and various binding types used. Additionally, the temperature of the loom environment, specifically in the zone of the warp threads or the loom shed, and the relative humidity can be entered through the keyboard. However, especially the temperature and the humidity can also be automatically entered as further parameters.

The micro-processor in the central processing unit 4 processes the inputs received from the databuses 3 and 5 and provides a respective selection signal through a databus 6 to a program memory or library 8. The programs stored in the library or memory 8 contain fixed parameters which are matched to the parameters inputted to the central processing unit 4. As a result of such matching a suitable start-up program is selected for controlling in closed loop fashion the start-up of the loom following a standstill. The start-up program, in addition to controlling the start-up, also controls other components of the loom, such as the fabric take-off control, the warp thread tension control, and so forth. Conventional fabric tension sensors on the fabric take up side and conventional warp thread tension sensors on the warp beam side are part of the loom control system to provide respective signals to the CPU 4. Similarly, the drive means for the warp beam and for the fabric take-up beam are also part of the loom control 2 for providing the respective controlled drive power to both beams. The instructions in accordance with the selected program are supplied through the databus 7 to the central processing unit 4 which in turn controls the loom control 2 through the databus 9 to perform a start-up operation for starting or restarting the loom. A complete start-up will be described below.

Figure 2:
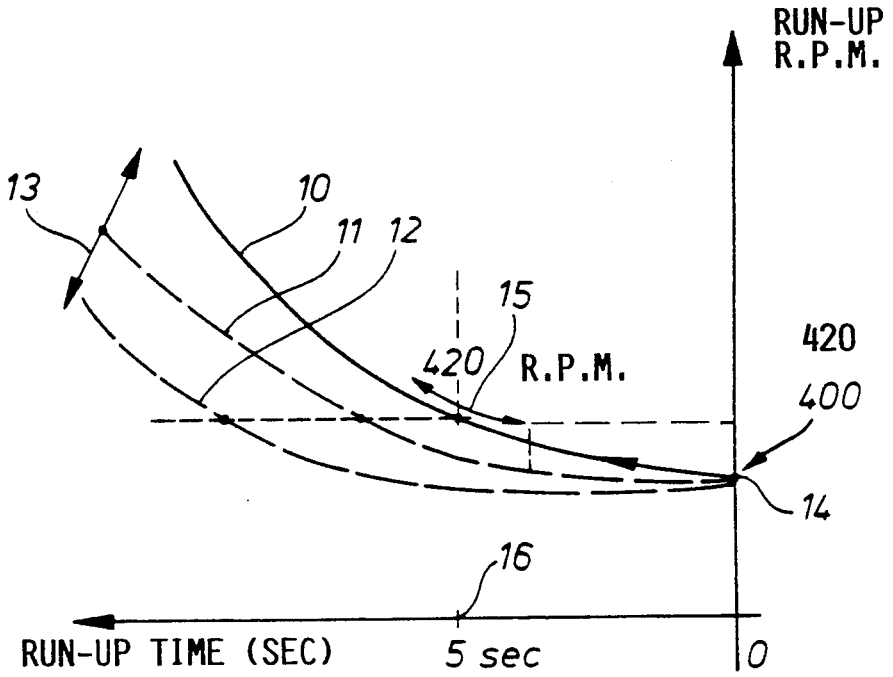
FIG. 2 shows a diagram of the r.p.m. as a function of the run-up time of the flywheel mass.

A start-up operation in accordance with the selected start-up program, will now be described with reference to FIG. 2. Point 14 on the ordinate along which the r.p.m. is plotted, indicates, for example, a fixed or rated loom r.p.m. of 400 which is the operational or load r.p.m. and also the idling r.p.m. which is to be maintained when the loom is weaving and when it is idling. The abscissa indicates the run-up time necessary for starting or restarting the loom. It is assumed that point 16 indicating 5 seconds is the time needed to normally reach the selected higher r.p.m. of, e.g. 420. The higher r.p.m. is an empirical value selected with regard to the requirement that when coupling the main loom shaft to the loom drive motor, the loom shaft must rotate substantially at the rated r.p.m. To satisfy this requirement a flywheel that will accelerate the loom shaft, must first be accelerated to the higher run-up r.p.m. The drive motor accelerates the flywheel to the higher r.p.m. without driving the loom shaft for charging the flywheel. The higher r.p.m. of the charged-up flywheel is an indication of the energy stored in the flywheel. Such energy must be sufficient to bring the loom shaft to the rated r.p.m. when the charged flywheel is coupled to the loom shaft while the motor is not energized.

Thus, it is assured that the loom shaft is already running at the rated r.p.m. when the electric loom drive motor starts driving the loom under normal operating load conditions, following run-up, to assure a smooth transition between run-up and normal drive.

If it is determined that the run-up time of 5 seconds for reaching the selected or higher no-load r.p.m. of 420 is not sufficient, because this run-up time is influenced singly or in combination by too many factors, such as the lubricant temperature, or the operational loom temperature, or the warp lift distance, or the type of binding, or the shaft number, or variations in the relay switching times and the like, the run-up time must be made longer. Generally, the run-up time must be modified, that is, increased or decreased, as indicated by the arrow 15. The direction of the arrow for either increasing or decreasing the selectable higher r.p.m. also includes the parameter of the cause for the standstill, such as a warp or weft thread break or other causes for a stopping of the loom. FIG. 2 further shows that ideal curves 10, 11, and 12 represent, for example, parameters for the loom lubricating oil temperature, the warp lift distance, and the type of binding currently employed. Further curves may represent other parameters, for example, the number of shafts. The double arrow 13 indicates that the individual curves may be shifted up or down, depending on still other influencing parameters. The intersection between the respective curve and the horizontal line representing the higher no-load r.p.m. then determines the particular run-up time needed.

If the selectable run-up r.p.m. of 420 should be found to be not the ideal selectable r.p.m. for all situations, it is possible to select another run-up r.p.m. according to the invention in order to avoid the fabric faults mentioned above. Thus, the run-up or selectable r.p.m. will change due to the type of the standstill, for example, whether a warp thread break caused the standstill or whether a weft thread break was the cause for stopping the loom. The size of the warp lift also has its influence. Thus, the selectable run-up r.p.m. will be selected in accordance with all of these parameters, including the operational temperature, the coolant temperature, and so forth. A weft thread break requires a different run-up than a warp thread break because when a broken weft thread is pulled out of its beat-up position the warp threads are left in a different tension state, due to the withdrawal of the broken weft thread, than when a broken warp thread is fixed which does not require any withdrawal of a weft thread.

Figure 3:
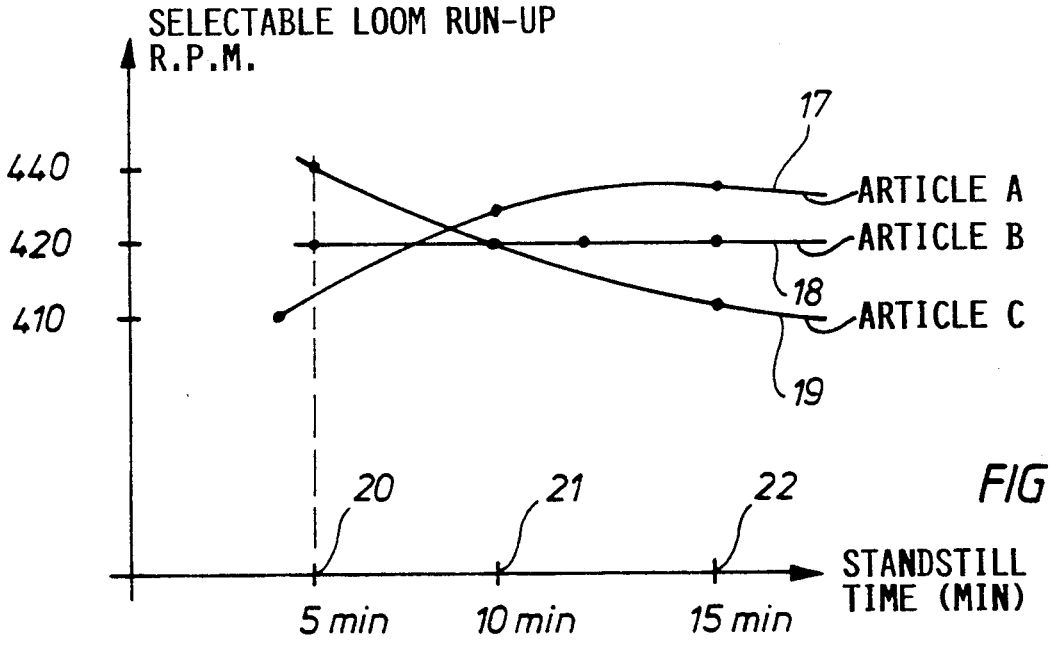
FIG. 3 shows the selectable flywheel r.p.m. as a function of the standstill time for several types of weave.

FIG. 3 shows the selection of the run-up r.p.m. as a function of the standstill time. FIG. 3 shows additionally that the selection of the run-up r.p.m. not only depends on the duration of the standstill time, but also on the type of the article that is presently being woven. Curves 17, 18, and 19 represent three different types of articles A, B, and C, respectively. For example, curve 19 representing article C has three different standstill times at points 20, 21, and 22, each related to another selectable run-up r.p.m., depending on the particular parameter involved. Still referring to curve 19, a run-up r.p.m. of about 412 applies to a standstill time of 15 minutes at point 22. A run-up r.p.m. of 420 applies to a standstill time of 10 minutes, at point 21. A run-up r.p.m. of 440 applies to a 5 minute standstill time at point 20. The different run-up times for Articles A and C in FIG. 3 depend on the yarn characteristics such as the elasticity of the individual yarn threads.

Figure 4:
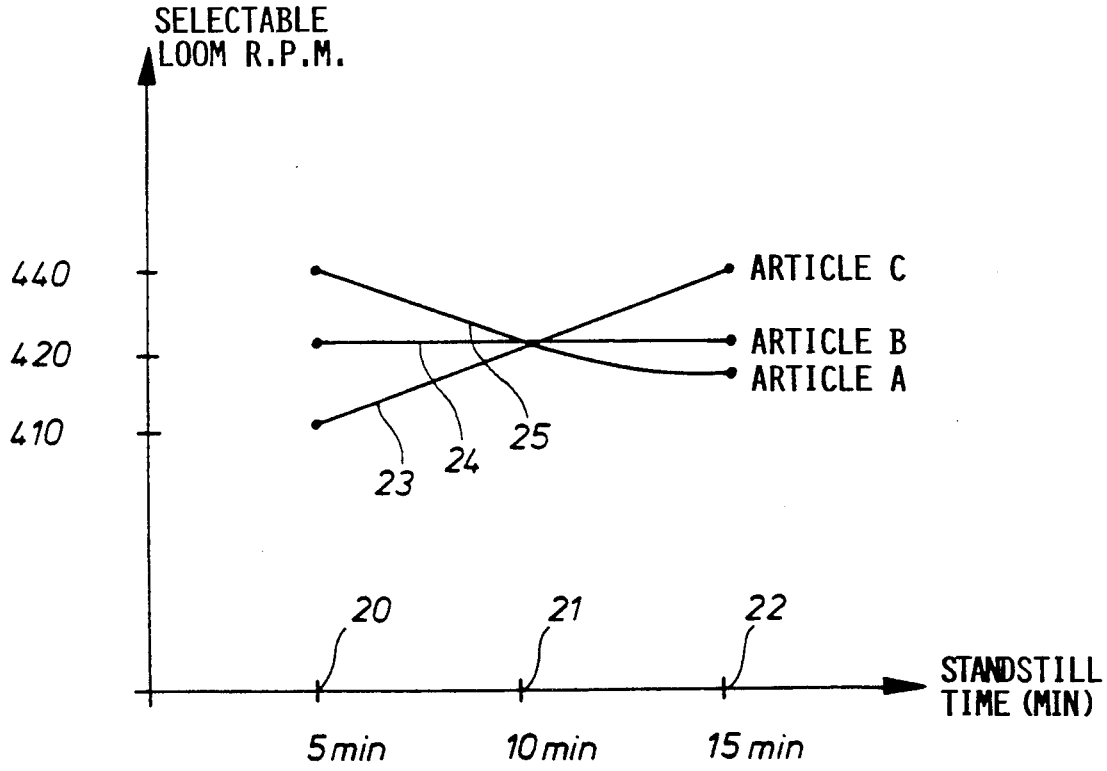
FIG. 4 shows the diagram of FIG. 3, for the same types of weave, however, for different operating parameters.

Referring to FIG. 4, the same articles A, B, and C will exhibit other selectable r.p.m. curves under different influences. However, it will be noted that article or fabric B is the least influenced, and has a run-up r.p.m. of 420 at the three different examples of the standstill times. Thus, the line or "curve" 24 corresponds to the curve or line 18. However, both articles A and C call for different run-up r.p.m.s as illustrated by curves or lines 23 and 25 in FIG. 4.

In view of the foregoing, the present method employs an artificial intelligence, so to speak, for controlling the start-up of the loom. The primary parameter is the standstill time as influenced by other parameters as explained above with reference to FIGS. 3 and 4. The invention avoids the above illustrated weaving faults by simple means.

More specifically, it has been found that the duration of the standstill or down time has a significant influence on the fabric or weave quality. Since the down time or standstill time varies within the range of about one minute to about thirty minutes, it is possible that certain of the weaving yarns, for example open-end spun yarns, are subjected to a permanent change in the elasticity of these yarns when the conventional starting method is applied. Stated differently, the resulting plastic deformations of these yarns show up as weaving faults in the finished fabric. The start-up method according to the invention prevents such fabric faults because the run-up characteristics of the loom can be influenced in response to the down time. Even the switching or operation of the loom control or regulator for the warp control and the weft control may be influenced in response to the down time.

The mentioned parameters are supplied according to the invention to the micro-processor located outside the loom. The micro-processor has an input through which the particular parameters can be inputted manually. These parameters involve the type of yarn to be woven on the loom, the type of loom including its machine parameters, the type of fabric to be woven, the regulator type, and the type of binding.

When the loom is at a standstill it supplies the above mentioned parameters to the micro-processor and the micro-processor in turn selects from the program memory or library that particular program which is required under the instantaneously prevailing parameters. Thus, the start-up program varies in response to the length of the standstill or down time, in response to the cause for the down time, for example, in response to the breaking of a weft thread or a warp thread, and in response to the type of binding which at the point of standstill was being used to weave the fabric.

The selected start-up or run-up program then influences the fabric take-off control, the warp control, and the entire start-up of the loom in such a way that the loom will reach a predetermined, selectable r.p.m. in accordance with the instantaneously prevailing parameters, including the machine typical parameters mentioned above, and including such parameters as temperature and relative humidity in the zone of the loom shed, that is the humidity to which the warp threads are exposed and which influences, for example, the warp tension.

It is an advantage of the invention that in dependence of all of the above mentioned parameters the required selected higher r.p.m. is selectable and reachable with the control according to the invention in the fastest possible way. Another advantage of the invention is seen in that the actual or operational r.p.m. is constantly measured and taken into account when determining the required higher run-up r.p.m. while also taking into account the variables that have been inputted manually and the variables that are stored in the memory. As a result, the optimal selectable r.p.m. is determined and applied in the shortest possible time.

A power loom is started by first accelerating a flywheel mass to a run-up r.p.m. higher than a rated operational r.p.m. of a loom drive shaft. During the run-up the flywheel mass is disconnected from the loom drive shaft but connected to the loom drive motor which is operated for the run-up or start-up at a higher r.p.m. than the rated operational r.p.m. during weaving. When the higher run-up r.p.m. has been reached, the flywheel mass is connected to the loom drive shaft while the loom drive motor is disconnected from its power supply so that only the energy stored in the accelerated flywheel mass accelerates the loom drive shaft to its rated r.p.m. Then, after the first beat of the reed the drive motor is electrically reconnected to its power supply for driving the loom at the rated r.p.m.

The higher motor r.p.m. for the run-up is obtained, e.g. through a frequency converter or by switching a multipole motor from a higher pole number, e.g., four poles to a lower pole number, e.g. two poles, whereby the motor operation at the higher pole number with a lower r.p.m. corresponds to the rated operational r.p.m. The pole switch-over takes place with such a delay, for example, that the full higher r.p.m. is not reached.

With the above run-up operation in mind, the flow diagram of FIGS. 5 and 6 will now be described. The parameter section of FIG. 5 from "start" to output A is the same in both FIGS. 5 and 6, and will be described only once.

Figure 5:
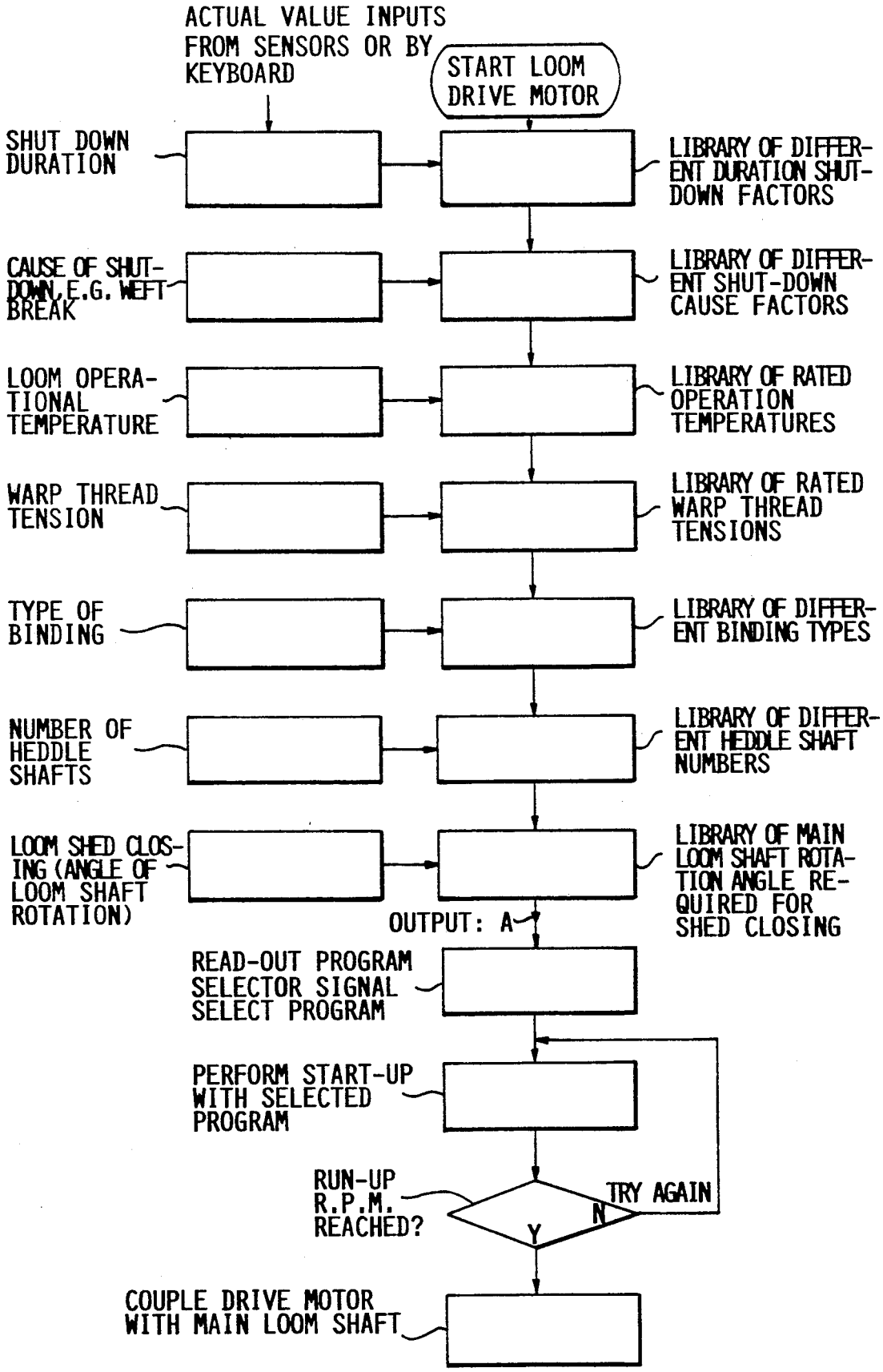
FIG. 5 is a flow diagram of a first sequence of steps in a program for starting a loom.

FIG. 5 is a flow diagram showing that, for example, seven actual parameter values are taken into account for selecting the appropriate run-up program. These actual values are entered by sensors or through the keyboard. The shut-down duration is ascertained by a time counter in the loom control 2. The shut-down cause may be entered manually or by a sensor, e.g. a conventional weft thread break sensor. Conventional sensors provide information regarding the loom temperature, the warp thread tension, and the type of binding. The number of heddle shafts and the loom shed closing angle as represented by a respective loom shaft rotation angle for example within the range of 310° to 350°, preferably e.g. 320°, may be entered by the operator. These values depend on the type of loom.

The look-up libraries represented by seven boxes have stored therein factors that represent a plurality of different values, e.g. shut-down factors for shut-down durations that increased, e.g. at one minute intervals. That factor will be selected that matches most closely the measured shut-down duration. Each of these libraries stores therein a plurality of factors and the factor matching best with the respective actual value will be selected for producing a program selector signal for selecting a run-up program also stored in a memory or library of the CPU 4. In this manner, that run-up program will be selected for a run-up operation which is best suited under the current operating conditions for avoiding start-up faults. The remainder of FIG. 5 is self-explanatory.

Figure 6:
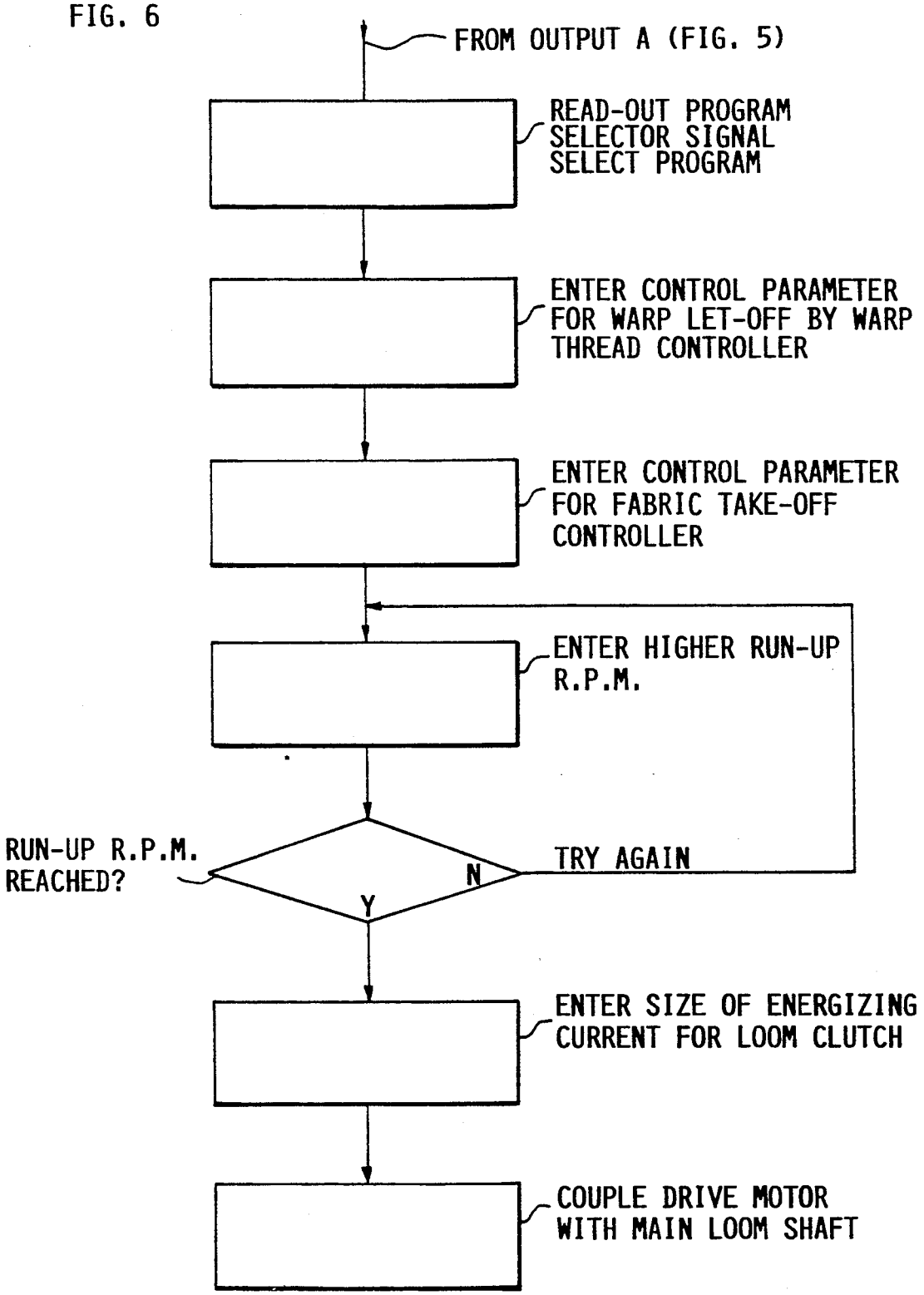
FIG. 6 is another flow diagram of a second sequence of steps in a program for starting a loom.

FIG. 6 also uses the result of the comparing or matching and selecting as performed in FIG. 5 up to "output A". The run-up sequence of FIG. 6 differs from that of FIG. 5 in that further control parameters are entered for a warp let-off control and for a fabric take-off control. The respective controllers are conventional, e.g. controllable motors for operating the warp beam and the fabric take-off beam.

Although the invention has been described with reference to specific example embodiments, it will be appreciated that it is intended to cover all modifications and equivalents within the scope of the appended claims.

What we claim is:

1. A method for starting up a power loom comprising the following steps:

(a) ascertaining a plurality of first parameters that influence the weaving quality, said first parameters including at least a standstill time duration, a cause for said standstill, and a weaving binding type employed at the instant when said standstill occurred, (b) supplying said first parameters to a micro-processor for producing a program selector signal, (c) selecting a start-up program from a plurality of start-up programs stored in a program memory connected to said microprocessor, said selecting taking place in accordance with said selector signal for providing a start-up program based on said selector signal, and (d) controlling said starting up in response to the selected start-up program.

2. The method of claim 1, further comprising supplying to said micro-processor at least one weaving quality influencing second parameter, producing said selector signal in response to said first and second parameters, and then performing said selecting and controlling steps.

3. The method of claim 2, wherein said second parameter is manually inputted through a keyboard connected to said micro-processor.

4. The method of claim 2, wherein said second parameter includes at least a temperature parameter, a humidity parameter, and machine typical parameters relevant for a desired loom start-up control.

5. The method of claim 4, wherein said machine typical parameters are: temperature of loom lubricant, warp thread tension, type of binding, number of shafts, type of loom.

6. The method of claim 1, further comprising determining a run-up r.p.m. in accordance with measuring an actual r.p.m. of a main drive shaft of said power loom during a run-up operation, comparing said actual r.p.m. with a selected run-up r.p.m., and controlling said actual r.p.m. in a closed loop manner until said actual r.p.m. has reached said run-up r.p.m.

7. The method of claim 1, further comprising entering into a program sequence a control parameter for controlling a fabric take-off controller by said microprocessor.

8. The method of claim 1, further comprising entering into a program sequence a control parameter for controlling a warp thread controller by said micro-processor.

9. The method of claim 1, further comprising entering into a program sequence a run-up r.p.m. that is higher than a rated operating r.p.m.

* * * * *